US008110537B2

(12) United States Patent
Gohl et al.

(10) Patent No.: US 8,110,537 B2
(45) Date of Patent: Feb. 7, 2012

(54) LIQUID DETERGENT COMPOSITION AND METHODS FOR USING

(75) Inventors: David W. Gohl, St. Paul, MN (US); Kim R. Smith, Woodbury, MN (US); Josh Kassanchuk, Golden Valley, MN (US); Brandon Carlson, Apple Valley, MN (US)

(73) Assignee: Ecolab USA Inc., St. Paul, MN (US)

( * ) Notice: Subject to any disclaimer, the term of this patent is extended or adjusted under 35 U.S.C. 154(b) by 1107 days.

(21) Appl. No.: 10/345,090

(22) Filed: Jan. 14, 2003

(65) Prior Publication Data

US 2004/0138084 A1 Jul. 15, 2004

(51) Int. Cl.
*C11D 1/66* (2006.01)
*C11D 1/62* (2006.01)
*C11D 3/26* (2006.01)

(52) U.S. Cl. ..... 510/328; 510/189; 510/197; 510/238; 510/245; 510/337; 510/350; 510/356; 510/360; 510/423; 510/433; 510/504; 510/506

(58) Field of Classification Search ..... 510/328, 510/329, 341, 350, 356, 361, 504, 506, 417, 510/372, 303, 321, 418, 189, 197, 238, 245, 510/337, 360, 423, 433
See application file for complete search history.

(56) References Cited

U.S. PATENT DOCUMENTS

| | | | | |
|---|---|---|---|---|
| 3,123,640 | A | 3/1964 | Longley | |
| 3,141,905 | A | 7/1964 | Longley | |
| 3,909,114 | A | 9/1975 | Haas et al. | |
| 3,997,460 | A | 12/1976 | Sirine et al. | |
| 4,244,840 | A | 1/1981 | Straw | |
| 4,515,704 | A | 5/1985 | Akred et al. | |
| 4,530,780 | A | 7/1985 | van de Pas et al. | |
| 4,556,504 | A | 12/1985 | Rek | |
| 4,561,993 | A | 12/1985 | Choy et al. | |
| 4,618,446 | A | 10/1986 | Haslop et al. | |
| 4,793,943 | A | 12/1988 | Haslop et al. | |
| 4,871,467 | A | 10/1989 | Akred et al. | |
| 4,992,194 | A | 2/1991 | Liberati et al. | |
| 5,006,273 | A | 4/1991 | Machin et al. | |
| 5,021,195 | A | 6/1991 | Machin et al. | |
| 5,073,285 | A | 12/1991 | Liberati et al. | |
| 5,108,644 | A | 4/1992 | Machin et al. | |
| 5,160,655 | A | 11/1992 | Donker et al. | |
| 5,281,356 | A | 1/1994 | Tsaur et al. | |
| 5,476,519 | A | 12/1995 | Haslop et al. | |
| 5,633,223 | A | 5/1997 | Vasudevan et al. | |
| 5,674,828 | A | 10/1997 | Knowlton et al. | |
| 5,723,426 | A * | 3/1998 | Zhen et al. | 510/337 |
| 5,883,065 | A * | 3/1999 | Swift, II et al. | 510/321 |
| 5,952,285 | A | 9/1999 | Hawkins | |
| 5,958,852 | A | 9/1999 | Yianakopoulos et al. | |
| 5,964,692 | A | 10/1999 | Blezard et al. | |
| 6,090,762 | A | 7/2000 | Clapperton et al. | |
| 6,150,324 | A | 11/2000 | Lentsch et al. | |
| 6,156,715 | A | 12/2000 | Lentsch et al. | |
| 6,164,296 | A | 12/2000 | Lentsch et al. | |
| 6,166,095 | A | 12/2000 | Bryan et al. | |
| 6,177,392 | B1 | 1/2001 | Lentsch et al. | |
| 6,177,396 | B1 | 1/2001 | Clapperton et al. | |
| 6,200,586 | B1 | 3/2001 | Lambie et al. | |
| 6,258,765 | B1 | 7/2001 | Wei et al. | |
| 6,323,246 | B1 * | 11/2001 | Nakama et al. | 516/27 |
| 6,369,021 | B1 | 4/2002 | Man et al. | |
| 6,380,144 | B1 * | 4/2002 | Bailley | 510/378 |
| 6,410,495 | B1 | 6/2002 | Lentsch et al. | |
| 6,410,501 | B1 * | 6/2002 | Jones et al. | 510/515 |
| 6,582,710 | B2 * | 6/2003 | Deckers et al. | 424/401 |
| 6,617,292 | B2 * | 9/2003 | Perron et al. | 510/119 |
| 6,762,158 | B2 * | 7/2004 | Lukenbach et al. | 510/122 |
| 6,833,129 | B2 * | 12/2004 | Loffler et al. | 424/70.11 |
| 2002/0035046 | A1 * | 3/2002 | Lukenbach et al. | 510/122 |
| 2003/0134771 | A1 * | 7/2003 | Ellson et al. | 510/515 |
| 2003/0171230 | A1 * | 9/2003 | Shana'a et al. | 510/130 |
| 2004/0152620 | A1 * | 8/2004 | Perron et al. | 510/499 |
| 2004/0167046 | A1 * | 8/2004 | Lukenbach et al. | 510/135 |

FOREIGN PATENT DOCUMENTS

| | | | |
|---|---|---|---|
| CA | 2023990 AA | | 2/1991 |
| CA | 2077253 AA | | 3/1993 |
| EP | 0038101 | | 10/1981 |
| EP | 151884 | A2 | 8/1985 |
| EP | 0160342 | B2 | 11/1985 |
| EP | 295021 | A2 | 12/1988 |
| EP | 303473 | A2 | 2/1989 |
| EP | 354010 | A2 | 2/1990 |
| EP | 430330 | A2 | 6/1991 |
| EP | 452106 | A2 | 10/1991 |
| EP | 510762 | * | 10/1992 |
| EP | 0 623 670 | A2 | 11/1994 |
| EP | 0 658 620 | A1 | 12/1994 |
| GB | 2223235 | A1 | 4/1990 |
| GB | 2304754 | A1 | 3/1997 |
| WO | WO 96/18713 | | 6/1996 |
| WO | WO 96/33254 | | 10/1996 |
| WO | WO 97/00938 | | 1/1997 |
| WO | WO 97/10321 | | 3/1997 |
| WO | WO 97/11145 | | 3/1997 |
| WO | WO 97/04338 | | 11/1997 |
| WO | WO98/04668 | * | 2/1998 |
| WO | WO 98/53131 | | 11/1998 |
| WO | WO98/53131 | * | 11/1998 |

OTHER PUBLICATIONS

Translation of U.S. Appl. No. 60/432,623, filed Dec. 12, 2002.*

(Continued)

*Primary Examiner* — Gregory Delcotto
(74) *Attorney, Agent, or Firm* — Faegre Baker Daniels LLP

(57) ABSTRACT

A liquid detergent composition is described. The liquid detergent composition includes an emulsion having a water phase and an oil phase. The liquid detergent composition includes a detersive amount of a nonionic surfactant component, an emulsion stabilizing amount of a cationic surfactant component, about 5 wt. % to about 94 wt. % water, and at least about 5 wt. % of a suspended particulate component. A detergent use solution and methods for using a liquid detergent composition are described.

16 Claims, No Drawings

OTHER PUBLICATIONS

Boltenhagen, P. et al., "Freeze-fracture observations in the L.alpha. phase of a swollen surfactant in the vicinity of the L3 and the L1 phase transitions", *J. Phys. II*, vol. 4, No. 8, pp. 1439-1448 (1994). (Abstract only).

Doerfler, H. et al., "Influence of glycerol on the formation of lyotropic mesophases—microscopic texture observations for determining preliminary phase diagrams of binary κ-soap/glycerol systems", *Colloid Polym. Sci*., vol. 271, No. 2, pp. 173-187 (1993). (Abstract only).

Dubois, M. et al., "Phase behavior and scattering of double-chain surfactants in diluted aqueous solutions", *Langmuir*, vol. 7, No. 7, pp. 1352-1360 (1991). (Abstract only).

Porte, G. et al., "Mixed amphiphilic bilayers: bending elasticity and formation of vesicles", *J. Chem. Phys*., vol. 102, No. 10, pp. 4290-4298 (1995). (Abstract only).

U.S. Appl. No. 09/907,483, filed Jul. 17, 2001.

U.S. Appl. No. 60/413,213, filed Sep. 23, 2002.

* cited by examiner

LIQUID DETERGENT COMPOSITION AND METHODS FOR USING

FIELD OF THE INVENTION

The invention relates to a liquid detergent composition and to methods of using a liquid detergent composition. The liquid detergent composition can be provided as a concentrate or as a use solution. When provided as a concentrate, the liquid detergent composition can be characterized as a water-in-oil emulsion containing a large amount of suspended particulates.

BACKGROUND OF THE INVENTION

Detergent compositions containing high levels of particulates are available as a solid or as a paste. Exemplary solid detergent compositions are described in U.S. Pat. No. 6,164,296 to Lentsch et al.; U.S. Pat. No. 6,177,392 to Lentsch et al.; U.S. Pat. No. 6,258,765 to Wei et al.; U.S. Pat. No. 6,369,021 to Man et al.; U.S. Pat. No. 6,156,715 to Lentsch et al.; U.S. Pat. No. 6,150,324 to Lentsch et al.; and U.S. Pat. No. 6,410,495 to Lentsch et al. Liquids can be generated from these solids by dissolving a portion of the solids in water in a dispenser that can utilize electronics to handle changes in water temperature and pressure.

Structured liquid compositions have been developed for use in the liquid detergent industry to increase the loading of generally non-soluble components in the liquid composition. The term "structured liquid composition" has been used to refer to pourable, fluid, non-Newtonian compositions that have the capacity physically to suspend solid particles by virtue of the presence of a surfactant mesophase or solid phase, which may be interspersed with a solvent phase. The surfactant phase can be represented as packed spherulites dispersed in the aqueous phase. Alternatively, a thin mobile lamellar phase or a bi-continuous reticular interspersion of aqueous and lamellar phases may be present. Structured liquid compositions are disclosed by, for example, European Publication No. 623,670; European Publication No. 38,101; European Publication No. 160,342; European Publication No. 104,452; U.S. Pat. No. 6,090,762 to Clapperton et al.; U.S. Pat. No. 5,952,285 to Hawkins; U.S. Pat. No. 5,021,195 to Machin et al.; U.S. Pat. No. 5,633,223 to Vasudevan et al.; and U.S. Pat. No. 4,244,840.

A liquid conditioner composition capable of containing a relatively large concentration of particulate water conditioning agent is described in U.S. application Ser. No. 09/907,483 that was filed with the United States Patent and Trademark Office on Jul. 17, 2001. U.S. application Ser. No. 09/907,483 is assigned to Ecolab Inc., the assignee of the present patent application.

SUMMARY OF THE INVENTION

A liquid detergent composition is provided according to the invention. The liquid detergent composition includes an emulsion having a water phase and an oil phase, and includes a detersive amount of a nonionic surfactant component, an emulsion stabilizing amount of a cationic surfactant component, about 5 wt. % to about 94 wt. % water, and at least about 5 wt. % of a suspended particulate component.

The nonionic surfactant component can include at least one of alcohol alkoxylates, alkyl phenol alkoxylates, alkyl polyglycosides, alkyl thiol alkoxylates, ethoxylate-propoxylate oligomers, alkoxylated esters, alkoxylated carboxylic acids, alkoxylated salts of carboxylic acids, ethers, amines, amine oxides, amides and mixtures thereof The cationic surfactant component can include a surfactant having the formula:

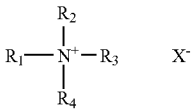

wherein $R_1$, $R_2$, $R_3$ and $R_4$ are independently selected from $C_1$-$C_{24}$ linear alkyl groups, $C_3$-$C_{24}$ branched alkyl groups, $C_3$-$C_{24}$ cyclic alkyl groups, $C_6$-$C_{24}$ aralkyl groups, and $C_4$-$C_{10}$ aryl groups, and $C_2$-$C_4$ alkoxy repeating groups; and X is an anion. At least one of $R_1$, $R_2$, $R_3$ and $R_4$ can be an alkoxylated group containing $C_2$-$C_4$ alkoxy repeating groups, wherein the number of repeating groups is between about 1 and about 100.

A detergent composition is provided according to the invention. The detergent composition includes a detersive amount of a nonionic surfactant component, an emulsion stabilizing amount of a cationic surfactant component, and water. The cationic surfactant component includes an ammonium surfactant having the formula:

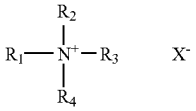

wherein $R_1$, $R_2$, $R_3$, and $R_4$ can be, independently of one another, $C_1$-$C_{24}$ linear alkyl groups, $C_3$-$C_{24}$ branched alkyl groups, $C_3$-$C_{24}$ cyclic alkyl groups, $C_6$-$C_{24}$ aralkyl groups, and $C_4$-$C_{10}$ aryl groups, and $C_2$-$C_4$ alkoxy repeating groups, wherein at least one of $R_1$, $R_2$, $R_3$, and $R_4$ is an alkoxylated group containing $C_2$-$C_4$ alkoxy repeating groups wherein the number of repeating groups is between about 1 and about 100, and X is an anion.

A method for using a liquid detergent composition is provided according to the invention. The method includes diluting a liquid detergent concentrate with water. The resulting diluted liquid detergent concentrate can be provided as a use solution and used for cleaning an article.

DETAILED DESCRIPTION OF THE INVENTION

A liquid detergent composition is provided according to the invention. The liquid detergent composition can be referred to more simply as the detergent composition. The detergent composition is provided in the form of a liquid which means that the composition is in the form of a pourable fluid when provided at room temperature. The detergent composition can be characterized as a concentrate when it is intended to be diluted. The detergent composition can be characterized as a use solution when it is provided in the form that is intended to be used for cleaning. In general, it is expected that the detergent composition will be made available as a concentrate and shipped and/or stored as a concentrate in order to avoid the expense associated with shipping and/or storing a composition containing a large amount of water.

The concentrate can be diluted at the location of use to provide a use solution. In addition, the concentrate can be diluted to provide a more dilute concentrate such as a ready to use composition that can be diluted to a use solution. It should be understood that the detergent composition can be utilized for cleaning when it is provided as a concentrate.

The detergent composition includes a nonionic surfactant component, a cationic surfactant component, water, and at least one of a suspended particulate component and a result of a suspended particulate component. The detergent composition can be provided in the form of an emulsion containing a suspended particulate component. When the detergent composition is diluted to a ready to use solution and/or a use solution, the suspended particulate component may remain as a particulate or it may become dissolved. An advantage of the invention is that the detergent composition can be provided as a concentrate containing a relatively large amount of suspended particulate component while remaining as a liquid. The concentrate can be provided as an emulsion such as a water-in-oil emulsion, and can be considered a structured liquid composition. The detergent composition can include additional components including dispersants, fatty soaps, solvents, dyes, fragrances, anti-redeposition agents, and liquid forms of the suspended particulate components.

Much of the discussion of the detergent composition will be provided in the context of a concentrate that contains a large load of suspended particulates and remain as a liquid. It is believed that the amount of water in the concentrate should be sufficient to allow the concentrate to be a liquid. It is expected that the concentrate will include at least about 5 wt. % water in order to maintain desired flow properties. The concentrate can include as much water as desired. It should be understood that as the water concentration approaches 100 wt. %, the composition resembles more of a use solution than a concentrate. In addition, an advantage of the invention is the ability to remain a stable liquid while containing a large amount of suspended particulate component. Accordingly, it is believed that the benefit of including a large amount of suspended particulate component begins to be lost when the concentration of water is greater than about 94 wt. %. The concentrate can contain between about 5 wt. % and about 94 wt. % water, between about 10 wt. % and about 90 wt. % water, between about 20 wt. % and about 80 wt. % water, and between about 30 wt. % and about 70 wt. % water.

Nonionic Surfactant Component

The nonionic surfactant component can be selected to provide the resulting use solution with desired detersive properties and to help maintain the stability of the emulsion containing suspended particulates. The nonionic surfactant component can include at least one of alcohol alkoxylates, alkyl phenol alkoxylates, alkyl polyglycosides, alkyl thiol alkoxylates, ethoxylate-propoxylate oligomers, alkoxylated esters, alkoxylated carboxylic acids, alkoxylated salts of carboxylic acids, ethers, amines, amine oxides, amides and mixtures thereof. Exemplary alcohol alkoxylates include linear or branched alkyl alcohol ethoxylates including those having between about 1 and about 20 ethylene oxide repeating units and an alkyl group containing between about 1 and about 20 carbon atoms. Exemplary alkyl phenol alkoxylates include linear or branched alkyl phenol ethoxylates having between about 1 and about 20 ethylene oxide repeating units and an alkyl group containing between about 1 and about 20 carbon atoms. Exemplary alkyl polyglucosides include those having an alkyl group containing between about 8 and about 20 carbon atoms and a degree of polymerization of between about 0 and about 10. An exemplary degree of polymerization is between about 0.5 and about 8, and between about I and about 5. Exemplary alkyl thiol alkoxylates include myristyl thioethoxylate. Exemplary nonionic surfactants include alkyl polyglycoside under the name Glucopon 625 from Cognis, alcohol ethoxylate available under the name Surfonic L24-3 from Huntsman Chemical, and secondary alcohol ethoxylate available under the name Tergitol 15 S-7 from Dow Chemical.

The nonionic surfactant component can include a mixture of different nonionic surfactants. When the nonionic surfactant component includes a mixture of different nonionic surfactants, it is desirable for one of the nonionic surfactants to have a cloud point above 30° C. and for another one of the nonionic surfactants to have a cloud point below 30° C. When the nonionic surfactant component includes a mixture of nonionic surfactants, it is desirable for at least one of the nonionic surfactants to be a secondary or branched alkoxylate. Exemplary alkoxylates include ethoxylates, propoxylates, ethoxylates-propoxylates, and mixtures thereof. The secondary alcohol ethoxylate available under the name Tergitol 15 S-7 has a cloud point of about 33° C. The alcohol ethoxylate available under the name Tergitol 24-3 has a cloud point of less than about 1° C. Both are exemplary alcohol alkoxylates that can be used according to the invention.

When the nonionic surfactant component is provided as a mixture of a nonionic surfactant having a cloud point above 30° C. and a nonionic surfactant having a cloud point below 30° C., the weight ratio of the nonionic surfactant having a cloud point below 30° C. to the nonionic surfactant having a cloud point above 30° C. can be between about 1:4 and about 1:16, between about 1:2 and about 1:10, and between about 1:1 and about 1:4. It should be understood that the ratios refer to the total amount of nonionic surfactant or surfactants having a cloud point below 30° C. to the total amount of surfactant or surfactants having a cloud point above 30° C.

The liquid detergent concentrate includes a sufficient amount of the nonionic surfactant component to provide the resulting use solution with a desired level of detersive properties. The liquid detergent concentrate can include the nonionic surfactant component in an amount at least about 0.1 wt. %. In order to provide sufficient room in the liquid detergent concentrate for other components, the nonionic surfactant component can be provided in an amount of less than about 80 wt. %. The liquid detergent concentrate can include the nonionic surfactant component in an amount of between about 10 wt. % and about 30 wt. %, and between about 15 wt. % and about 25 wt. %.

Cationic Surfactant Component

The cationic surfactant component is provided in the detergent composition to help stabilize the suspended particulate component when the detergent composition is provided as a concentrate. In addition, the cationic surfactant component is expected to provide detersive properties in the resulting use solution. The cationic surfactant component can include any cationic surfactants that help stabilize the suspended particulate in the concentrate. Exemplary cationic surfactants include amphoteric surfactants under acidic conditions, quaternary ammonium surfactants under any pH conditions, amine salts under acidic conditions, and mixtures thereof. Exemplary amphoteric surfactants include cocoamidopropylbetaines, lauramine oxides, and coco-ampho-acetates. Exemplary amine salts include tetradecyldimethyl amines and acid salts thereof, and cocodi(ethoxy) amines and acid salts thereof. Exemplary quaternary ammonium surfactants include alkoxylated and non-alkoxylated ammonium surfactants. Exemplary ammonium surfactants include those having the following formula:

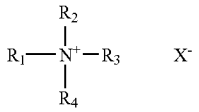

wherein $R_1$, $R_2$, $R_3$ and $R_4$ are independently selected from $C_1$-$C_{24}$ linear alkyl groups, $C_3$-$C_{24}$ branched alkyl groups, $C_3$-$C_{24}$ cyclic alkyl groups, $C_6$-$C_{24}$ aralkyl groups, and $C_4$-$C_{10}$ aryl groups, and $C_2$-$C_4$ alkoxy repeating groups, wherein any of the groups can contain a heteroatom, such as, oxygen, nitrogen, and sulfer, and any of the groups can contain at least one ester group, hydroxy group, carboxy group, sulfate group, amide group, and amine group. Exemplary ammonium surfactants include those having the above structure wherein at least one of $R_1$ to $R_4$ is an alkoxylated group containing $C_2$-$C_4$ alkoxy repeating groups wherein the number of repeating groups is between about 1 and about 100. The alkoxylated groups can be ethoxy repeating groups, propoxy repeating groups, butoxy repeating groups, ethoxy and propoxy repeating groups, etc. Exemplary alkoxylated groups include propoxy having about 10 to about 60 repeating units, propoxy having about 20 to about 50 repeating units, and propoxy having about 30 to about 40 repeating units. An ammonium surfactant containing at least one alkoxylated group can be referred to as an alkoxylated ammonium surfactant. In the above structure, X is an anion. Exemplary anions include chloride, iodide, bromide, fluoride, acetate, phosphate, and sulfate.

Exemplary alkoxylated ammonium surfactants include those wherein $R_1$, $R_2$, and $R_3$ are independently selected from lower alkyl groups, such as, $C_1$-$C_4$ alkyl groups, and $R_4$ is a polyoxyalkylene groups selected from at least one of:

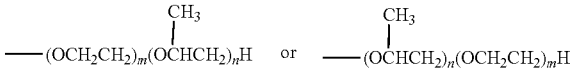

wherein m is from 0 to 30, n is from 1 to 60, and m plus n is from 1 to 60, and n>m. The ratio of n/m can be at least 2, at least 4, and can be greater than 5 in the case where m is equal to or greater than 1. It should be understood that it is possible for m to be 0. The value of m+n can be within the range of 5 to 60, can be within the range of 8 to 50, and can be m=0 and n=35-45.

In the case of an alkoxylated ammonium surfactant wherein $R_4$ is an alkoxylated group, the total number of carbon atoms among $R_1$, $R_2$ and $R_3$ can have a combined number of 12 carbon atoms or fewer than 12 carbon atoms. In addition, the total number of carbon atoms in the $R_1$, $R_2$ and $R_3$ groups can be between 3 and 12 carbon atoms, and can be between 4 and 8 carbon atoms. Exemplary surfactants include those where $R_1$, $R_2$ and $R_3$ are provided as one methyl radical and two ethyl radicals.

The anion can be fairly inert in the system except for its solubility characteristics, which are well understood in the art. Simple anions, especially simple or lower molecular weight acid anions such as chloride, bromide, iodide, sulfate, paratoluene sulfonate, acetate, nitrate, nitrite, phosphate, and the like can be selected as the counterion ion in the cationic surfactant.

Exemplary cationic surfactants include those described in U.S. Pat. No. 3,123,640 and U.S. Pat. No. 3,141,905 as cation-active surface active chemical compounds. The cation-active compounds can include quaternary ammonium compounds derived from lower monoalkyl dialkanolamines. In addition, cation-active compounds include a) dialiphatic, dialkoxylated quaternary ammonium compounds, and b) monoaliphatic, trialkoxylated quaternary ammonium compounds, as described by formulae in the patents, and are useful in the practice of the invention as the polyoxyalkylene ammonium cationic surfactants. Those patents are incorporated herein for the disclosure of the structure of those classes of compounds.

In the description of chemical structures and formulae, where the term "group" is used, that terminology is specifically intended to reflect the ability of one ordinarily skilled in the art to use substituted or unsubstituted materials from within the defined class. With regard to the specific example of "alkyl group," that term would reflect and is intended to cover not only hydrocarbons which literally fit within the definition of alkyl (e.g. methyl, ethyl, propyl, hexyl, cyclohexyl, isooctyl, dodecyl, stearyl and the like), but also those types of substituted alkyl compounds which one of the ordinary skill in the art would select for minor or specifically intended variations in the physical and/or chemical properties effected by the substitution such as chloromethyl, hydroxyethyl, ethylene sulfonate, 4-cyanobutyl, ethylene-ethyl ether ($—CH_2CH_2OCH_2CH_3$), ethylene-ethyl thioether, dodecyl carboxylate (and its ester), 3,4-dibromobutyl, and the like. Where the term "alkyl moiety" is used, that term encompasses only unsubstituted alkyl. Similarly, the term a "compound having the central nucleus" refers to all chemical compounds which have the identified chemical structure defined for the nucleus, with the option of having substitution thereon which does not alter the bond structure defined in the formula. For example, a central structure of the formula:

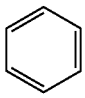

would include, phenyl, para-hydroxy phenyl, 1,3-dichlorophenyl, 2,4,6-trimethylphenyl, naphthyl, benzamidazol (attached through the benzyl ring), and the like, but would not include cyclohexane, piperidine, or the like, as those changes alter the bond structure of the ring. The terminology of a ring or substituent of the formula limits the structure to the specific groups and positions for substitution as shown.

Exemplary cationic surfactants are commercially available, for example, as Witco Chemicals Cationic quaternary ammonium compounds Emcol CC-9, Emcol CC-36, and Emcol CC-42. A preferred compound is commercially provided as Glensurf™42, which is inaccurately described as "Diethylammonium Chloride" in a Product Data Sheet provided by Glenn Corporation, which sells the product. The CAS number for the actual compound is 68132-96-7, its Chemical Abstract name is Poly[oxy(methy-1,2-ethanediyl)], alpha-[2-diethylmethylammonium)ethyl]-omega-hydroxy chloride . Exemplary cationic surfactants that can be used according to the invention include those characterized as having a cloud point of less than about 30° C. In addition, exemplary cationic surfactants that can be used include those having a cloud point of less than about 20° C. The alkoxylated ammonium surfactant available under the name Glensurf™42 has a cloud point of about 13° C.

Exemplary cationic surfactants that can be included as part of the cationic surfactant component include didecyldimethylammonium chloride, myristyltrimethylammonium chloride, ditallowdimethylammonium methosulfate, diethyldi (polypropoxy)ammonium chloride, diethylmethylpoly(propoxy)ammonium chloride, and mixtures thereof. An exemplary cationic surfactant is propoxylated quaternary ammonium chloride that is available under the name Variquat CC-42NS from DeGussa.

The concentrate can include the cationic surfactant component in an amount sufficient to help maintain the concentrate as a suspension of particulates. The liquid detergent concentrate can include the cationic surfactant component in an amount of at least about 0.5 wt. %. In addition, the concentrate can include the cationic surfactant component in an amount of less than about 20 wt. %. The liquid detergent concentrate can include the cationic surfactant component in an amount of between about 0.5 wt. % and about 20 wt. %, between about 2 wt. % and about 10 wt. %, and between about 3 wt. % and about 8 wt. %.

The detergent composition can include a ratio of nonionic surfactant to cationic surfactant that maintains an emulsion that helps suspend the particulate component. In general, that the weight ratio of nonionic surfactant to cationic surfactant can be between about 1:1 and about 8:1, between about 2:1 and about 6:1, and between about 3:1 and about 5:1.

Suspended Particulate Component

The phrase "suspended particulate component" refers to a component in the concentrate that remains as a particulate suspended in the concentrate. The particulate component may be soluble or slightly soluble or non-soluble in either the liquid phase or the oil phase. The reference to the "suspended particulate component" refers to the component that remains as a particulate and is not solubilized when the detergent composition is provided as a concentrate. As the concentrate is diluted, the suspended particulate component may become solubilized in either the water phase or the oil phase, or it may remain as a particulate. When the weight percent of the suspended particulate component in the concentrate is identified, it should be understood that the weight percent refers to the suspended particulate component that remains as a particulate and is not dissolved. That is, the weight percent of suspended particulate component in the concentrate does not include the amount of the component that may be solubilized.

The suspended particulate component of the concentrate can be any component that can be suspended as a particulate that will provide a benefit for the resulting use solution. It is expected that various particulates will provide beneficial properties in a detergent use solution. The suspended particulate can include a mixture of different particulates, and can include builders, bleaching agents, bleaching activators, pH modifiers, antimicrobial agents, abrasives, anti-deposition agents, sequestrants, softeners, conditioners, viscosity modifiers, wetting modification agents, and enzymes. The particulate component may include components that are water soluble or water insoluble. If the components are water soluble, the component should be incorporated at such a level in the composition that its maximum level of solubility in the composition is exceeded. Certain components that are available in particulate form can be included in the composition in liquid form if it is not desirable to have that particular component available as a particulate. The reference to a "suspended particulate component" refers to the component that remains as a particulate in the concentrate. Certain components that make up the suspended particulate component may be provided in the concentrate as a liquid and may be dissolved in either or both of the water phase and the oil phase. It is expected that the concentrate will include as much of the suspended particulate component as possible while retaining the properties of a liquid. In general, it is expected that the concentrate will contain the suspended particulate component in an amount of between about 1 wt. % and about 80 wt. %.

The suspended particulate component should include particulates that have a size sufficient to allow the suspended particulate component to remain suspended in the concentrate. It is expected that if the particulates are too large, they will not remain suspended in the concentrate. In general, it is expected that the size of the particulates should be less than about 1,000μ. It is expected that the particulates will have a size of at least about 0.1 μm, and can be a size of between about 10 μm and about 500 μm. Many of the components that can make up the suspended particulate component are available in particulate form and many are also available in liquid form. Accordingly, the concentrate can include both particulate and liquid forms of the same component and may include particulate forms of one or more components and liquid forms of another component. It should be understood that the detergent composition can include any of the following identified suspended particulate components in particulate form and the detergent composition can include the liquid form of the same components if they are available in liquid form.

Builders and sequestrants that can be used as the suspended particulate component include organic builders, inorganic builders, and mixtures thereof. Exemplary organic builders include organic compounds, such as, the salts or acid form of nitriloacetic acid and its derivatives, amino carboxylates, organic phosphonates, amides, polycarboxylates, salicylates and their derivatives, sodium aluminosilicates, zeolites, and derivatives of polyamino compounds or mixtures thereof. Examples of nitriloacetic acid derivatives include sodium nitriloacetate and magnesium nitriloacetate, etc. Exemplary amino carboxylates include sodium iminosuccinates. Exemplary organic phosphonates include amino tri(methylene phosphonate), hydroxyethylidene disphosphonate), diethylenetriamine penta(methylenephosphonate), ethylenediamine tetra(methylenephosphonate), and 2-phosphono-butane-1,2,4-tricarboxylate (available under the name Bayhibit AM). Exemplary polycarboxylates include citric acid and its salts and derivatives, sodium glutarate, potassium succinate, and polyacrylic acid and its salts and derivatives and copolymers. Exemplary polyamino compounds would include ethylene diamine (EDTA), diethyltriaminepentaacetic acid (DPTA), hydroxyethylene diamine, and their salts and derivatives. Exemplary organic builders include at least one of a builder selected from polyacrylates or their copolymers, iminodisuccinate, citrate, ethylenediamine or triamine derivatives, and mixtures thereof. Exemplary inorganic builders include sodium tripolyphosphate, sodium carbonate, sodium pyrophosphate, potassium pyrophosphate, magnesium phosphate, tetramethylammonium phosphate, sodium phosphate, zeolites, and silicates.

When the detergent composition includes builders and sequestrants as the suspended particulate component, the builders and sequestrants can be provided in an amount of between about 1 wt. % and about 80 wt. % and between about 10 wt. % and about 30 wt. %, based on the weight of the detergent composition.

Exemplary bleaching agents that can be used as the suspended particulate component include sodium percarbonate, sodium persulfate, sodium perborate, urea peroxide, calcium hypochlorite, sodium dichloroisocyanurate, phthalimidoperoxyalkanoic acids such as PAP, hydrogen peroxides, oxone peracids, peracetic acids, and peroxy salts such as peroxymonosulfuric acid, peroxydisulfuric acid, diammonium peroxydisulfate, and disodium peroxydisulfate.

When the detergent composition includes bleaching agents as the suspended particulate component, the bleaching agents can be provided in an amount of between about 1 wt. % and about 30 wt. % and between about 2 wt. % and about 10 wt. %, based on the weight of the detergent composition.

Exemplary corrosion inhibitors that can be used in the concentrate as the suspended particulate component include amines and silicates.

When the detergent composition includes corrosion inhibitors as the suspended particulate component, the corrosion inhibitors can be provided in an amount of between about 0.1 wt. % and about 5 wt. % and between about 1 wt. % and about 3 wt. %, based on the weight of the detergent composition.

Exemplary antimicrobials that can be used as the suspended particulate component include: quaternary ammonium compounds such as alkyldimethylbenzylammonium chloride; 2,2-dibromo-3-nitrilopropionamide; alkyl parabens such as methyl paraben and propyl paraben; phenolic derivatives such as t-amylphenol; metals and their oxides and salts such as silver, silver iodide, zinc oxide; halgenated hydantoin derivatives such as bromochlorodimethylhydantoin, dichlorodimethylhydantoin, dibromodimethylhydantoin; hypohalites such as calcium hypochlorite, sodium hypobromite; and oligomers or polymers such as povidone iodine or povidone peroxide.

When the detergent composition includes antimicrobials as the suspended particulate component, the antimicrobials can be provided in an amount of between about 0.001 wt. % and about 3 wt. % and between about 0.5 wt. % and about 2 wt. %, based on the weight of the detergent composition.

Exemplary bleach activators that can be used as the suspended particulate component include materials that react with an oxidizing agent to release a peracid, including tetraacetylethylenediamine and its salts (TAED), sodium nonoyloxybenzene sulfonate, nitrilo compounds, and esters. Other types of bleach activators that can be used include materials which can enhance the formation of singlet oxygen from an oxidizing agent such as molybdenum, cobalt, copper, chromium, silver, and their derivatives. Additional bleach activators include morpholinium acetonitriles, glycolates, acetyl caprolactum, and cyanopiperidine.

When the detergent composition includes bleach activators as the suspended particulate component, the bleach activators can be provided in an amount of between about 0.5 wt. % and about 10 wt. % and between about 1 wt. % and about 5 wt. %, based on the weight of the detergent composition.

Exemplary pH modifiers that can be used as the suspended particulate component include inorganic acidic compounds (sodium hydrogen sulfate, calcium hydrogen phosphate, etc.) organic acid compounds (carboxylic acids such as oxalic acid, polyacrylic acid, etc.), inorganic alkaline compounds (hydroxides, silicates, carbonates, etc.), and organic alkaline compounds (amines, alkoxides, etc.).

When the detergent composition includes pH modifiers as the suspended particulate component, the pH modifiers can be provided in an amount of between about 1 wt. % and about 30 wt. % and between about 5 wt. % and about 15 wt. %, based on the weight of the detergent composition.

Exemplary abrasives suitable for use as the suspended particulate component include calcium carbonate, talc, sodium aluminosilicate, zeolite, pieces of polymeric material such as shredded polyethylene or polypropylene, and pumice.

When the detergent composition includes abrasives as the suspended particulate component, the abrasives can be provided in an amount of between about 0.5 wt. % and about 10 wt. % and between about 1 wt. % and about 5 wt. %, based on the weight of the detergent composition.

Exemplary anti-redeposition agents that can be used as the suspended particulate component include polyacrylates and their copolymers, and cellulosic materials such as hydroxypropylcellulose, hydroxyethylcellulose, and carboxymethylcellulose.

When the detergent composition includes anti-redeposition agents as the suspended particulate component, the anti-redeposition agents can be provided in an amount of between about 0.1 wt. % and about 10 wt. % and between about I wt. % and about 5 wt. %, based on the weight of the detergent composition.

Exemplary softeners or conditioners that can be used as the suspended particulate component include both fabric and skin softeners. Exemplary softeners include quaternary ammonium compounds, fatty alcohols, fatty esters, fatty alcohols, glycerine, vitamins, and amino acids.

When the detergent composition includes softeners or conditioners as the suspended particulate component, the softeners or conditioners can be provided in an amount of between about 1 wt. % and about 30 wt. % and between about 5 wt. % and about 20 wt. %, based on the weight of the detergent composition.

Exemplary viscosity modifiers that can be used as the suspended particulate component include alkanolamides, alkanolamines, inorganic bases and acids, polyacrylic acid and its salts and copolymers, and cellulosic polymers.

When the detergent composition includes viscosity modifiers as the suspended particulate component, the viscosity modifiers can be provided in an amount of between about 0.1 wt. % and about 5 wt. % and between about 0.5 wt. % and about 2 wt. %, based on the weight of the detergent composition.

Exemplary wetting modification agents that can be used as the suspended particulate component include: EO-PO derivatives, silane derivatives, and cationic surfactants.

When the detergent composition includes wetting modification agents as the suspended particulate component, the wetting modification agents can be provided in an amount of between about 0.1 wt. % and about 5 wt. % and between about 0.5 wt. % and about 3 wt. %, based on the weight of the detergent composition.

Exemplary enzymes that can be used as the suspended particulate component include proteases, lipases, amylases, cellulases, oxydases, peroxydases, esterases, and mixtures thereof. The liquid detergent concentrate can include an enzyme in an amount of between about 0.1 wt. % and about 10 wt. %, and between about 1 wt. % and about 5 wt. %.

The suspended particulate component of the concentrate can be provided in an amount sufficient to provide the detergent use solution with desired properties resulting from the suspended particulate component. It is expected that the amount of the suspended particulate component in the concentrate will vary depending upon the particulate selected and the desired effect of the selected particulate. The applicants have found that the concentrate can include a fairly high amount of suspended particulate component while maintaining desired stability and flowability properties. It is expected that many liquid compositions that contain a high level of particulate component would result in an increase in viscosity rendering the composition relatively difficult to dispense using a pump or an aspirator. The liquid detergent concentrate according to the invention can include up to about 80 wt. % of the suspended particulate component and remain as a liquid that is pourable and can be pumped or aspirated. Although the concentrate according to the invention can include a relatively high amount of suspended particulate component, it is expected that the concentrate can include an amount of the suspended particulate component that is as low as 1 wt. %. The liquid detergent concentrate can include the suspended particulate component in an amount of between about 5 wt. % and about 60 wt. % and between about 15 wt. % and about 40 wt. %. It should be understood that these ranges of the suspended particulate component can refer to individual types of suspended particulate components as identified above and cumulative suspended particulate components. In addition, these ranges can be applied to any of the groups of the suspended particulate components notwithstanding the previously identified exemplary ranges.

The liquid detergent concentrate includes a sufficient amount of water to maintain the emulsion as a stable suspension of particulates. In general, a stable suspension can be characterized by a lack of phase separation when the concentrate is allowed to sit at room temperature for at least 7 days. It is expected that more desirable concentrates will not phase separate when allowed to sit at room temperature for at least 14 days, and preferably at least 30 days. A liquid concentrate is not stable if the concentrate forms a separate phase or layer that contains at least 5% of the volume of the liquid concentrate. It is expected that the liquid concentrate according to the invention may form a skim layer at the top of the liquid concentrate that represents less than 5% of the total volume of the liquid concentrate. The formation of a skim layer does not demonstrate a lack of stability of the liquid concentrate.

The liquid detergent concentrate can include at least about 5 wt. % water in order to maintain stability and thereby provide a concentrate that will flow to provide desired dispensing of the concentrate. It is expected that there is practically no upper limit on the amount of water that can be provided in the detergent composition except that the composition should include desired detersive properties. The detergent composition can include a sufficient amount of water to provide the detergent composition as a use solution. In general, it is desirable to ship the detergent composition as a concentrate and then dilute the concentrate to a use solution at a another location in order to save on transportation costs. In order to minimize the amount of water in the concentrate, the water can be provided at a concentration of less than about 94 wt. %. The liquid detergent concentrate can include between about 10 wt. % and about 90 wt. % water, between about 20 wt. % and about 80 wt. % water, and between about 30 wt. % and about 70 wt. % water.

The composition can include a solvent to provide a use solution having desired properties. It should be understood that the detergent composition can be provided without a solvent. Exemplary solvents that can be used in the detergent composition include glycol ethers, alkanolamines, pyrrolidones, alkyl carbonates, terpenes, and glycols. An exemplary glycol ether is available under the name Butyl Cellusolve from Union Carbide. Exemplary alkanolamines include alkanolamines, ethanolamines, diethanolamines, triethanolamines, isopropylamines, 2-methyl-2-hydroxypropylamines, and tetradecyldiethanolamines. Exemplary pyrrolidones include N-methylpyrrolidones and N-ethylpyrrolidones. Exemplary alkyl carbonates include $C_1$-$C_4$ alkyl carbonates. Exemplary terpenes include d-limonene. Exemplary glycols include ethylene glycol, propylene glycol, butylene glycol, pentylene glycol, and hexylene glycol. Exemplary derivatives of glycol include ester acetates.

When the concentrate includes a solvent, the solvent can be provided in an amount sufficient to provide the desired benefit to the use solution. For example, the amount of solvent in the concentrate can be between about 1 wt. % and about 50 wt. %, between about 5 wt. % and about 30 wt. %, and between about 10 wt. % and about 25 wt. %.

The detergent composition can include additional components that may be provided for modifying the aesthetic qualities or the functionality of the composition. Exemplary components that modify the aesthetic qualities of a composition include dyes and fragrances.

Additional components that can be included in the detergent composition include dispersants. Dispersants can be used in cleaning compositions to handle the hardness found in water. It should be understood that the dispersant is an optional component. Dispersants that can be used according to the invention include those that are referred to as "lime soap dispersants." In general, it is understood that dispersants have a tendency to interfere with precipitation of anionic surfactants caused by water hardness.

Dispersants that can be used according to the invention can include a polymer and/or an oligomer containing pendant carboxylic acid groups and/or pendant carboxylic acid salt groups. It should be understood that the term "pendant" refers to the groups being present other than in the polymer backbone and/or oligomer backbone. The dispersants can be available as homopolymers or co-polymers or as homoligomers or co-oligomers. Exemplary dispersants include poly(acrylic acid), poly (acrylic acid/maleic acid) co-polymers, poly(maleic acid/olefin) co-polymers, phosphino carboxylated polymers, and mixtures thereof. The dispersants can be soluble or dispersible in the concentrate and can be a component that does not significantly increase the viscosity of the concentrate or of the use solution relative to its absence. The dispersant can be a homopolymer or co-polymer, and can have a molecular weight range of about 300 to about 5,000,000, and can have a molecular weight range of about 2,000 to about 2,000,000, and can have a molecular weight range of about 3,000, to about 500,000. The dispersant can include repeating units based upon acrylic acid, maleic acid, polyols, olefins, and mixtures thereof. An exemplary dispersant is a maleic anhydride/olefin co-polymer. An exemplary maleic anhydride/olefin co-polymer is available from Rohm & Haas under the name of Acusol 460N. An exemplary polyacrylic acid sodium salt having a molecular weight of about 4,500 is available from Rohm & Haas under the name Acusol 434N. An exemplary acrylic acid/maleic acid co-polymer having a molecular weight of about 3,200 is available from Rohm & Haas under the Acusol 448. An exemplary acrylic acid/maleic acid sodium salt having a molecular weight of about 70,000 is available from Rohm & Haas under the name Acusol 479N. An exemplary acrylic acid/maleic acid sodium salt having a molecular weight of about 40,000 is available from Rohm & Haas under the name Acusol 505N. In general, if the dispersant is provided as an acid, its pH may be adjusted to neutral or alkaline. The pH adjustment may be provided prior to forming the concentrate or during the formation of the concentrate. In addition, the pH adjustment may occur at any time prior to or during dilution with the water of dilution to provide the use solution. The dispersant can be provided in the concentrate in an amount sufficient, when taken in consideration of the amount of sheeting agent and/or humectant, to provide resistance to precipitation of the anionic surfactant component when diluted with hard water. In general, the concentrate can contain between about 0.01 wt. % and about 10 wt. % dispersant, between about 0.2 wt. % and about 5 wt. % dispersant, and between about 0.5 wt. % and about 1.5 wt. % dispersant.

The detergent composition, when provided as a concentrate, can be characterized as a structured liquid composition that includes a relatively large amount of a suspended particulate component. The reference to a structured liquid composition refers to the ability of the composition to remain a liquid so that it can be poured or pumped or aspirated. The reference to a relatively large amount of a suspended particulate component refers to an amount of the suspended particulate component in excessive of what would be suspended if the composition were not structured.

The detergent composition can be provided with little or no anionic surfactant. Anionic surfactants have a general tendency to complex with cationic surfactants, and the resulting complex has a tendency to fall out of solution. The detergent composition according to the invention can include a structured liquid composition containing a relatively large amount of suspended particulate component without the use of an anionic surfactant. If an anionic surfactant is present in the composition, it can be provided in an amount so that the weight ratio of anionic surfactant to cationic surfactant is less than about 0.5, less than about 0.1, or less than about 0.01. In addition, by limiting the amount of anionic surfactant, it is not necessary to incorporate additional components to help stabilize the anionic surfactant relative to the cationic surfactant and keep the two from complexing.

The detergent composition can be provided so that it includes little or no phosphate materials. Preferably, the detergent composition includes no phosphates so that the detergent composition can be used in non-phosphate markets. If the detergent composition includes phosphates, the phosphates can be provided in the concentrate at a concentration of less than about 8.7 wt. %.

The detergent composition can be characterized as a structured liquid that includes an emulsion and a suspended particulate component. The detergent composition can be characterized as a structured liquid composition because it can contain a relatively large amount of suspended particulate components. In addition, the detergent composition can be characterized as including little or no anionic surfactant. In general, if the composition includes an anionic surfactant, it can be provided at a ratio to other surfactants of less than about 0.1:1. It should be understood that the composition can be provided without any anionic surfactant.

The concentrate can be provided with the exemplary ranges of components identified in Table 1.

TABLE 1

| Component | wt. % | wt. % | wt. % |
|---|---|---|---|
| water | 5-94 | 10-90 | 20-80 |
| nonionic surfactant component | 0.1-80 | 10-30 | 15-25 |
| cationic surfactant component | 0.5-20 | 2-10 | 3-8 |
| suspended particulate component | 1-80 | 5-60 | 15-40 |

The detergent composition can be provided in the form of a solution, a unit dose, a liquid crystal, a water-in-oil emulsion, an oil-in-water emulsion, a dispersion, a microemulsion, or a gel. Use solutions may be applied as a liquid, a foam, a paste, or a gel.

The liquid detergent concentrate can be characterized as having a viscosity that allows it to be dispensed through an orifice. It is expected that the liquid detergent concentrate will be dispensed through an orifice in most situations by either pumping or aspirating. If the viscosity of the liquid detergent concentrate is too high, it may be difficult to pump the concentrate using a standard fluid pump or by using a consumer-type spray bottle. In order to provide desired dispensing of the concentrate, it is desirable for the concentrate to have a Brookfield viscosity of less than about 10,000 cps. and an oscillation viscosity profile or cotan delta of greater than about 1. The Brookfield viscosity can be between about 50 cps and about 10,000 cps, between about 100 cps and about 5,000 cps, and between about 200 cps and about 3,000 cps. The oscillation viscosity profile or cotan delta can be greater than about 5, and greater than about 10.

The stability of the concentrate can be characterized by properties including conductivity, yield point, and small angle x-ray scattering (SAXS). The concentrate can include a conductivity of less than about 30 mS/cm, a conductivity of less than about 10 mS/cm, and a conductivity of less than about 5 mS/cm. The concentrate can include a yield point of greater than about 0.5 pascal, greater than about 1.0 pascal and greater than about 2.0 pascals. The concentrate can include a small angle x-ray scattering (SAXS) exhibiting a peak between about 1.5 and about 2.5 on the 2 theta axis. In general, it is understood that if peak is observed, there is a level of order in the system. If no peak is observed, it is expected that the system lacks order.

The detergent composition can be used as a hard surface cleaner, an antimicrobial formulation, a textile cleaning composition, a process water-treatment composition, a fruit and vegetable wash and an insecticide. Exemplary hard surface cleaners include vehicle detergent compositions, vehicle presoak compositions, vehicle brightener compositions, vehicle parts cleaner compositions, enzymatic cleaner compositions, surgical instrument cleaning compositions, window cleaning compositions, dish cleaning compositions, floor cleaning compositions, food processing plant cleaning compositions, food contact area cleaning compositions, rust remover compositions, floor finish stripper compositions, and bathroom soil removal compositions. The detergent composition can be used to clean ceramic substrates often encountered in the tub, tile, and shower applications. Exemplary antimicrobial formulations include antimicrobial compositions for plants, antimicrobial compositions for animals, and antimicrobial compositions for hard surfaces. Exemplary textile cleaning compositions include textile detergent compositions, textile bleaching compositions, textile presoaking compositions, textile souring compositions, textile enzymatic cleaning compositions, and textile sanitizer compositions. The detergent composition can be used as a concentrate. An exemplary use application for the concentrate is as a laundry pre-spotter.

The detergent composition can be used as a grill-cleaning product as described in U.S. Patent Application Ser. No. 60/413,213 that was filed with the United States Patent and Trademark Office on Sep. 23, 2002. The entire disclosure of U.S. Application Ser. No. 60/413,213 is incorporated herein by reference. In particular, the disclosure of Table 3 of U.S. Application Ser. No. 60/413,213 is incorporated herein by reference.

The total amount of the cationic surfactant component and the nonionic surfactant component in various use solutions may vary depending upon the desired application for the use solution. In general, it is desirable to provide enough of the surfactant components to provide the desired level of cleaning, and it is generally desirable not to use too much of the surfactant component in order to avoid the costs associated with using more than necessary to provide the desired level of cleaning. In most applications, it is expected that the use solution will contain at least 10 ppm of the combination of cationic surfactant and nonionic surfactant, and will include less than about 10,000 ppm of the combination of cationic surfactant and nonionic surfactant. In addition, it is expected that the use solutions will contain between about 11 ppm and about 5,000 ppm of the combination of cationic surfactant and nonionic surfactant. In the case of laundry washing and ware washing, it is expected that the use solution will target about 10 ppm to about 100 ppm of the combination of cationic surfactant and nonionic surfactant. In the case of vehicle washing (the washing of the exterior of motor vehicles), it is expected that the use solution will contain between about 2,000 ppm and about 5,000 ppm of the combination of the total cationic surfactant and nonionic surfactant. In the case of laundry washing, it is expected that the use solution will target between about 500 ppm and 5,000 ppm of the combination of cationic surfactant and nonionic surfactant.

The liquid detergent concentrate can be diluted with water to provide a use solution. The step of diluting can take place by pumping into a water stream, aspirating into a water stream, pouring into water, or by combining water with the concentrate.

An advantage of the detergent composition according to the invention is that a use solution can be prepared from the concentrate containing a relatively higher percent of component resulting from the suspended particulate component relative to the total surfactants in the use solution compared with many commercially available products. For example, the ratio of the builder or sequestrant component to the total surfactant component in the detergent composition can be provided at a ratio of at least about 1:1, at least about 4:1, and can be provided at a ratio of up to about 10:1. In addition, the ratio can be provided at between about 4:1 to about 8:1.

EXAMPLE 1

Effect of Propoxylated Cationic Compound on Stability

The compositions identified in Table 2 were prepared with and without a cationic surfactant. For composition A below, the composition was unstable and quickly phase separated. Addition of a cationic surfactant (Composition B) stabilized the system. The full solubility of an oil-soluble dye (Oil Soluble Brown) in the emulsion but not a water-soluble dye (FD&C Blue #1) demonstrated that the continuous phase of the emulsion was oil rather than water, indicating a water-in-oil emulsion. Microscopic examination under regular and polarized light showed the absence of spherulites as described in U.S. Pat. No. 4,793,943 or the wormlike network described in U.S. Pat. No. 5,021,195.

In the following compositions, the secondary alcohol ethoxylate is available as Tergitol 15 S-7 from Dow Chemical, the alcohol ethoxylate is available as Surfonic L24-3 from Huntsman Chemical, and the propoxylated quaternary ammonium chloride is available under the name Variquat CC-42NS from DeGussa.

TABLE 2

| | A | B |
|---|---|---|
| Component | | |
| water | 42.2 | 40.3 |
| secondary alcohol ethoxylate | 16.6 | 11.4 |
| alcohol ethoxylate | 3.4 | 2.4 |
| sodium carboxymethylcellulose | 1.3 | 1.2 |
| silicone defoamer | 0.2 | 0.2 |
| tetrasodium ethylenediaminetetraacetate | 36.3 | 30.3 |
| propoxylated quaternary ammonium chloride | 0 | 5.2 |
| Properties | | |
| conductivity (mS/cm) | 0.9 | 0.4 |
| pumpable | yes | yes |

EXAMPLE 2

Other Builders

Compositions C & D were prepared and are reported in Table 3. The following compositions were observed to be stable.

TABLE 3

| | C | D |
|---|---|---|
| Component | | |
| water | 48.8 | 42.9 |
| secondary alcohol ethoxylate | 14.1 | 3.0 |
| alcohol ethoxylate | 2.9 | 0.6 |
| sodium carboxymethylcellulose | 1.5 | 1.3 |
| silicone defoamer | 0.2 | 0.2 |
| sodium iminodisuccinate | 25.0 | 50.6 |
| propoxylated quaternary ammonium chloride | 6.5 | 1.4 |
| Properties | | |
| conductivity (mS/cm) | 11.1 | 14.2 |
| pumpable | yes | |

EXAMPLE 3

Other Cationic Additives

Compositions E & F were prepared and are reported in Table 4. The following compositions were observed to be stable.

TABLE 4

| Component | E | F |
|---|---|---|
| water | 22.7 | 50.3 |
| secondary alcohol ethoxylate | 6.4 | 14.2 |
| alcohol ethoxylate | 1.3 | 3.0 |
| silicone defoamer | 0.2 | 0.2 |
| sodium iminodisuccinate | 0 | 25.2 |
| sodium tetraacetylethylenediamine | 66.7 | 0 |
| choline chloride | 2.9 | 0.9 |
| propoxylated quaternary ammonium chloride | 0 | 6.5 |
| pumpable | yes | yes |

EXAMPLE 4

Removal of Polymerized Soil

Composition C (the concentrate) was diluted with tap water to 1 wt. % of the concentrate. Steel coupons coated with heat-polymerized corn oil were placed in the solution overnight. By morning, the polymerized oil on the wetted area had fallen off the coupon. Compositions containing 0.1 wt. % of the individual components of Composition C, did not affect the coated coupons. This demonstrates the effectiveness of the composition of this invention as a potent hard surface cleaner without the need to resort to harsh chemicals such as sodium hydroxide.

EXAMPLE 5

Removal of Rust

Composition C was diluted with tap water to provide 1 wt. % of the concentrate. Pouring the diluted material over a rusty steel step stool removed significant amounts of rust, demonstrating the effectiveness of the composition as a rust remover. Similar treatment of the rusted area with water alone gave no rust removal.

EXAMPLE 6

Removal of Floor Finish

A 10 wt. % clear dilution of composition C (pH 10) was placed on a floor tile coated with a finish. The wetted area was then abraded with a green scrub pad, affording complete removal of the finish without the need for extreme pH or organic solvents.

While the specification has been described in detail with respect to specific embodiments thereof, it will be appreciated that those skilled in the art, upon obtaining an understanding of the foregoing, may readily conceive of alterations to, variations of, and equivalents to these embodiments. Accordingly, the scope of the present invention should be assessed as that of the appending claims and any equivalents thereto.

The invention claimed is:

1. A structured liquid detergent composition comprising:

(a) about 1 wt % to about 80 wt % of a nonionic surfactant component, wherein the nonionic surfactant component comprises a mixture of a first, linear nonionic surfactant and a second, branched nonionic surfactant, wherein the weight ratio of the first nonionic surfactant to the second nonionic surfactant is about 1:4 to about 1:16;

(b) about 1 wt % to about 20 wt % of a cationic surfactant component, wherein the cationic surfactant component comprises a propoxylated quaternary ammonium surfactant having the following formula:

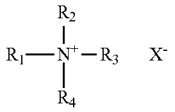

wherein $R_1$, $R_2$, $R_3$ are alkyl groups having 1 to 4 carbons and R4 is a polyoxyalkylene group;

(c) about 5 wt % to about 94 wt % water; and (d) at least about 5 wt % of a suspended solid particulate component;

wherein the weight ratio of the nonionic surfactant component to the cationic surfactant component is about 1:1 to about 8:1 and the structured liquid detergent composition has a conductivity of less than about 30 mS/cm.

2. The structured liquid detergent composition according to claim 1, wherein the composition comprises at least 10 wt % water.

3. The structured liquid detergent composition according to claim 1, wherein the composition comprises up to about 80 wt % of the suspended particulate component.

4. The structured liquid detergent composition according to claim 1, wherein the suspended particulate component comprises at least one of builders, bleaching agents, bleach activating agents, pH modifiers, antimicrobial agents, abrasives, anti-redeposition agents, sequestrants, softeners, conditioners, viscosity modifying agents, wetting modifying agents, and mixtures thereof.

5. The structured liquid detergent composition according to claim 1, wherein the suspended particulate component comprises particulates having a size of between about 0.1 um and about 1000 um.

6. The structured liquid detergent composition according to claim 1, wherein the composition has a Brookfield viscosity of between about 50 cps and about 10000 cps.

7. The structured liquid detergent composition according to claim 1, wherein the composition has an oscillation viscosity profile (elastic/inelastic) of at least about 5.

8. The structured liquid detergent composition according to claim 1, wherein the composition has a yield point of greater than about 0.5 pascal.

9. The structured liquid detergent composition according to claim 1, wherein the composition has a small angle x-ray scattering peak between 1.5 and 2.5 on the 2 theta axis.

10. A structured liquid detergent composition comprising:

(a) about 1 wt % to about 80 wt % of a nonionic surfactant component including a branched nonionic surfactant and a linear nonionic surfactant, wherein the nonionic surfactant component comprises at least one of alcohol alkoxylates, alkyl phenol alkoxylates, alkyl polyglycosides, alkyl thiol alkoxylates, ethoxylate-propoxylate oligomers, alkoxylated esters, alkoxylated carboxylic acids, alkoxylated salts of carboxylic acids, ethers, amines, amine oxides, amides and mixtures thereof;

(b) about 1 wt % to about 20 wt % of a cationic surfactant component comprising a propoxylated quaternary ammonium surfactant, wherein the weight ratio of the nonionic surfactant component to the cationic surfactant component is about 1:1 to about 8:1, and wherein the propoxylated quaternary ammonium surfactant has the following formula:

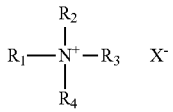

wherein $R_1$, $R_2$, $R_3$ are alkyl groups having 1 to 4 carbons and R4 is a polyoxyalkylene group;

(c) water; and (d) a builder or sequestrant;

wherein the weight ratio of the builder or sequestrant to the total amount of the nonionic surfactant component and the cationic surfactant component is at least about 1:1 and the composition has a conductivity of less than about 30 mS/cm.

11. The structured detergent composition according to claim 10, wherein the ratio of the builder or sequestrant to the total amount of nonionic surfactant component and cationic surfactant component is greater than about 4:1.

12. The structured liquid detergent composition according to claim 1, wherein the size of the suspended particulate component is less than 1000um.

13. The structured liquid detergent composition according to claim 1, wherein the size of the suspended particulate component is less than 500 um.

14. The structured liquid detergent composition of claim 1, wherein the nonionic surfactant is a secondary or branched alcohol alkoxylate.

15. The structured liquid detergent composition of claim 1, comprising from about 10 wt % to about 30 wt % of the nonionic surfactant component, from about 2 wt % to about 10 wt % of the cationic surfactant component, from about 10 wt % to about 90 wt % water and from about 5 wt % to about 60 wt % of the suspended particulate component.

16. The structured liquid detergent composition of claim 15, comprising from about 15 wt % to about 25 wt % of the nonionic surfactant component, from about 3 wt % to about 8 wt % of the cationic surfactant component, from about 20 wt % to about 80 wt % water and from about 15 wt % to about 40 wt % of the suspended particulate component.

* * * * *